US008066065B2

(12) United States Patent
Buckner

(10) Patent No.: US 8,066,065 B2
(45) Date of Patent: Nov. 29, 2011

(54) EXPANSION DEVICE

(75) Inventor: Robert Kenneth Buckner, Rowlett, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 138 days.

(21) Appl. No.: 12/534,778

(22) Filed: Aug. 3, 2009

(65) Prior Publication Data

US 2011/0024134 A1 Feb. 3, 2011

(51) Int. Cl.
*E21B 23/01* (2006.01)

(52) U.S. Cl. ..... 166/118; 166/378; 166/382; 166/387; 166/138; 166/179

(58) Field of Classification Search ..... 166/378, 166/381, 382, 387, 386, 118, 135, 138
See application file for complete search history.

(56) References Cited

U.S. PATENT DOCUMENTS

| | | | | |
|---|---|---|---|---|
| 2,153,035 | A * | 4/1939 | Burt | 29/413 |
| 2,879,851 | A * | 3/1959 | Wilson et al. | 166/216 |
| 3,006,416 | A * | 10/1961 | Roach et al. | 166/217 |
| 3,024,843 | A | 3/1962 | Hanes | |
| 3,109,493 | A | 11/1963 | Carter | |
| 3,506,067 | A | 4/1970 | Lebourg | |
| 3,623,551 | A | 11/1971 | Randermann, Jr. | |
| 6,793,022 | B2 * | 9/2004 | Vick et al. | 166/382 |
| 6,902,008 | B2 | 6/2005 | Hirth et al. | |
| 7,373,973 | B2 | 5/2008 | Smith et al. | |
| 7,475,736 | B2 * | 1/2009 | Lehr et al. | 166/386 |
| 2007/0102165 | A1 * | 5/2007 | Slup et al. | 166/387 |

FOREIGN PATENT DOCUMENTS

| | | | |
|---|---|---|---|
| EP | 1408195 | A1 | 4/2004 |
| WO | 2007058864 | A1 | 5/2007 |

OTHER PUBLICATIONS

Foreign communication from a related counterpart application—International Search Report and Written Opinion, PCT/GB 2010/001503, Oct. 14, 2010, 16 pages.

* cited by examiner

*Primary Examiner* — Jennifer H Gay
*Assistant Examiner* — Elizabeth Gottlieb
(74) *Attorney, Agent, or Firm* — John W. Wustenberg; Conley Rose, P.C.

(57) ABSTRACT

An expansion device for a wellbore servicing tool, comprising a wedge comprising a frusto-conical wall having a tip end, the wedge being configured coaxially along a central axis, a plurality of slip segments, each slip segment comprising an inner surface having an incline surface, and at least one bridge joining each of the incline surfaces to the frusto conical wall. A method of operating a wellbore servicing tool, comprising longitudinally compressing an expansion device along a central axis, upon sufficient compression, separating plural slip segments from a wedge, moving the wedge relative to the slip segments, upon sufficient movement of the wedge relative to the slip segments, separating at least two slip segments from each other.

20 Claims, 7 Drawing Sheets

EXPANSION DEVICE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to packer and bridge plug type tools used in wellbores.

BACKGROUND OF THE INVENTION

Packer tools and other wellbore isolation devices sometimes have elements that undesirably protrude radially and inadvertently contact a wellbore, a casing within a wellbore, or other object. Such contact sometimes results in damage to the packer tool and/or premature transitioning of the device from a run in configuration to a set configuration. For example, some conventional slip segments of wellbore isolation devices are held together somewhat tightly against a mandrel through the use of one or more bands. The bands may be intended to stretch or fracture when the tool is activated in order to allow deployment. However, the bands offer limited resistance to inadvertent deployment when the wellbore isolation devices undergoes inadvertent perturbation.

SUMMARY OF THE INVENTION

Disclosed herein is an expansion device for a wellbore servicing tool, comprising a wedge comprising a frusto-conical wall having a tip end, the wedge being configured coaxially along a central axis, a plurality of slip segments, each slip segment comprising an inner surface having an incline surface, and at least one bridge joining each of the incline surfaces to the frusto conical wall.

Also disclosed herein is a method of operating a wellbore servicing tool, comprising longitudinally compressing an expansion device along a central axis, upon sufficient compression, separating plural slip segments from a wedge, moving the wedge relative to the slip segments, upon sufficient movement of the wedge relative to the slip segments, separating at least two slip segments from each other.

DETAILED DESCRIPTION OF THE PREFERRED EMBODIMENTS

Figure 1:
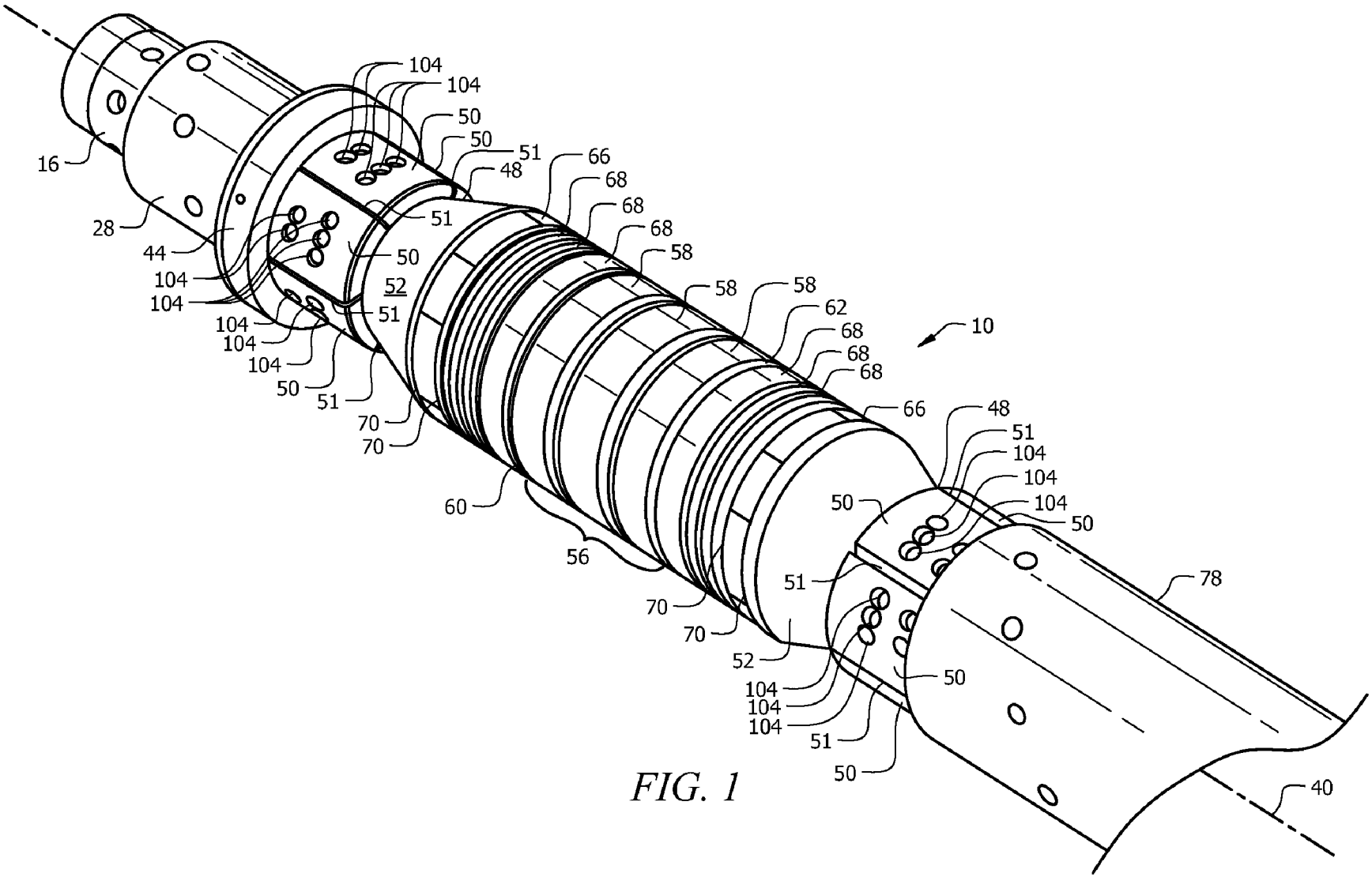
FIG. 1 is an oblique view of a bridge plug tool in its run in configuration according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation.

As used herein, the term "zonal isolation tool" will be used to identify any type of actuatable device operable to control the flow of fluids or isolate pressure zones within a well bore, including but not limited to a bridge plug, a fracture plug, and a packer. The term zonal isolation tool may be used to refer to a permanent device or a retrievable device.

As used herein, the term "bridge plug" will be used to identify a downhole tool that may be located and set to isolate a lower part of the well bore below the downhole tool from an upper part of the well bore above the downhole tool. The term bridge plug may be used to refer to a permanent device or a retrievable device.

As used herein, the terms "seal", "sealing", "sealing engagement" or "hydraulic seal" are intended to include a "perfect seal", and an "imperfect seal. A "perfect seal" may refer to a flow restriction (seal) that prevents all fluid flow across or through the flow restriction and forces all fluid to be redirected or stopped. An "imperfect seal" may refer to a flow restriction (seal) that substantially prevents fluid flow across or through the flow restriction and forces a substantial portion of the fluid to be redirected or stopped.

The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 2:
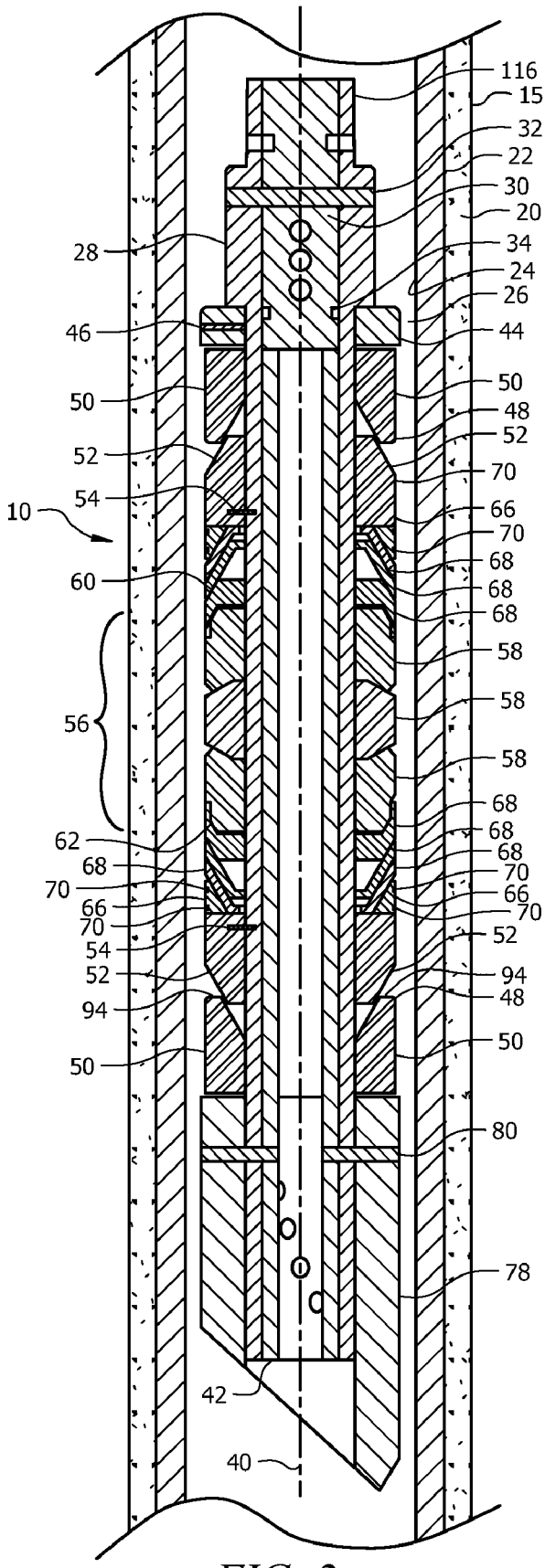
FIG. 2 is a cross-sectional view of the bridge plug tool of FIG. 1 in its run in configuration and within a well.

FIG. 1 is an oblique view of a zonal isolation tool 10 in an unset or run in configuration. In FIG. 2, the tool 10 is shown in the unset configuration in a well 15. The well 15 may be either a cased completion with a casing 22 cemented therein by cement 20 as shown in FIG. 2 or an open hole completion. Tool 10 is shown in set configuration in FIG. 6. Casing 22 has an inner surface 24. An annulus 26 is defined between casing 22 and tool 10. Tool 10 has a packer mandrel 28, and is referred to as a bridge plug due to a plug 30 being pinned within packer mandrel 28 by radially oriented pins 32. Packer mandrel 28 lies along a longitudinal central axis 40 of the tool 10. An inner tube 42 is disposed in and is pinned to packer mandrel 28 by pin 80 to help support plug 30. It will be appreciated that while, in this embodiment, the packer mandrel 28 and the inner tube 42 may be separate elements, in other embodiments, the packer mandrel 28 and the inner tube 42 may be formed integrally as a single piece. Plug 30 has a seal means 34 located between plug 30 and the internal diameter of packer mandrel 28 to prevent fluid flow therebetween. The overall tool 10 structure, however, is adaptable to other zonal isolation tools referred to as packers, which typically have at least one means for allowing fluid communication through the tool. Packers may therefore allow for the controlling of fluid passage through the tool by way of one or more valve mechanisms which may be integral to the packer body or which may be externally attached to the packer body. More specifically, some embodiments of a packer tool may comprise a check valve device carried within the tool instead of a plug 30 so that flow is selectively allowed through the packer mandrel 28. Packer tools may be deployed in wellbores having casings or other such annular structure or geometry in which the tools may be set.

Tool 10 includes a spacer ring 44 which is preferably secured to packer mandrel 28 by shear pins 46. Spacer ring 44 provides an abutment which serves to axially retain an expansion device 48 which is positioned circumferentially about packer mandrel 28. Generally, expansion device 48 comprises plural slip segments 50 integrally joined to a wedge 52 disposed generally below the slip segments 50. Wedge 52 is initially positioned pinned into place by shear pins 54.

Figure 6:
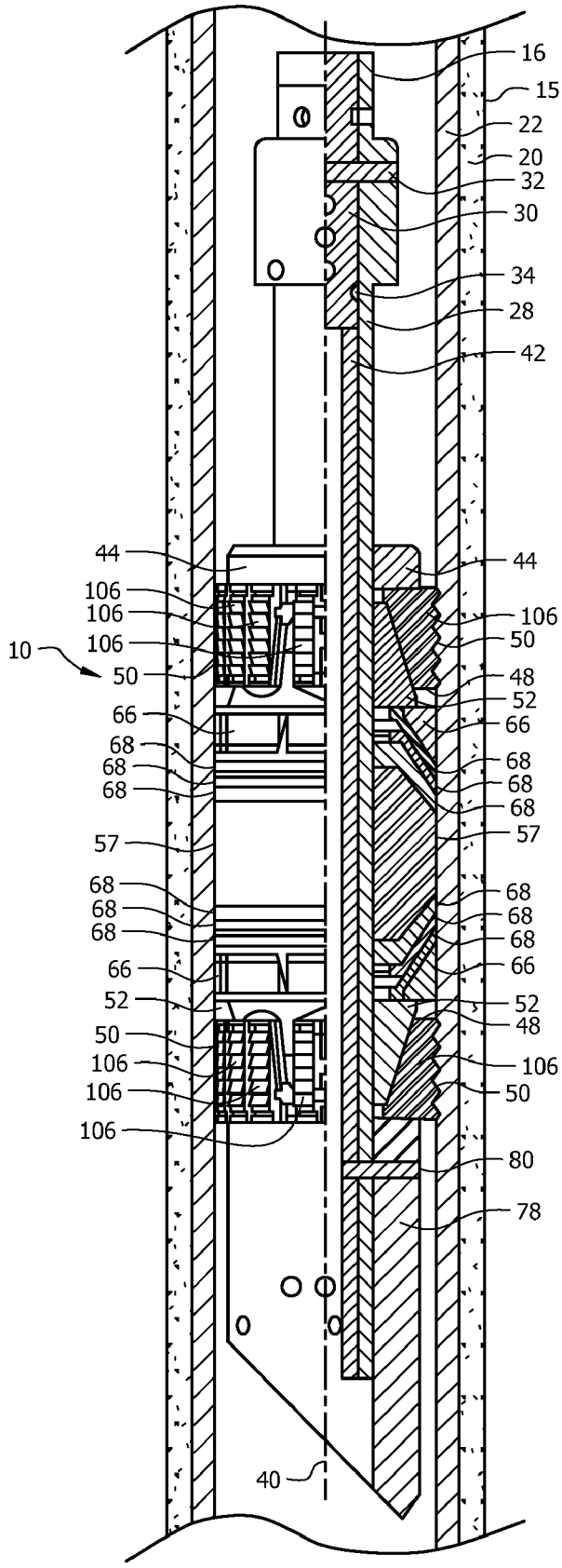
FIG. 6 is a cross-sectional view of the bridge plug tool of FIG. 1 in its set configuration within a well.

Located below wedge 52 is a packer element assembly 56, which includes at least one packer element 57 as shown in FIG. 6, or as shown in FIG. 2, may include a plurality of expandable packer elements 58 positioned about packer mandrel 28. Packer element assembly 56 has an unset configuration shown in FIGS. 1 and 2 and a set configuration shown in FIG. 6. Packer element assembly 56 has an upper end 60 and a lower end 62.

At the lowermost portion of tool 10 is an angled portion, referred to as mule shoe 78, that is secured to packer mandrel 28 by pin 80. Another expansion device 48, also comprising plural slip segments 50 integrally joined to a wedge 52 disposed generally below the slip segments 50, is located just above mule shoe 78. The lower wedge 52 is also pinned in place by shear pins 54. The lowermost portion of tool 10 need not be mule shoe 78, but may be any type of section which will serve to prevent downward movement of the lower expansion device 48 and terminate the structure of the tool 10 or serve to connect the tool 10 with other tools, a valve or tubing, etc. It will be appreciated by those in the art that shear pins 46 and 54, if used at all, are pre-selected to have shear strengths that allow for the tool 10 to be set and deployed and to withstand the forces expected to be encountered in the well 15 during the operation of the tool 10.

Located just below upper expansion device 48 is a segmented backup shoe 66. Located just above lower expansion device 48 is another segmented backup shoe 66. As seen best in FIG. 1, the backup shoes 66 comprise a plurality of segments, e.g. eight, in this embodiment. The multiple segments of each backup shoe 66 are held together on mandrel 28 by retaining bands 70 carried in grooves on the outer surface of the backup shoe 66 segments. The tool 10 further comprises a plurality of extrusion limiters 68 that serve to limit undesirable extrusion of packer elements 57, 58.

With the exception of the expansion devices 48, the elements of the tool 10 described to this point of the disclosure are known to those having ordinary skill in the art of drillable bridge plugs and/or packers. Further, substantially similar tools and descriptions of their operation can be found in U.S. Pat. No. 7,373,973 which is hereby incorporated by reference in its entirety. Accordingly, the discussion below further describes and explains operation and use of the expansion devices 48, thereby enabling use of such expansion devices 48 in bridge plugs, other types of packers, other zonal isolation tools and/or devices within which the expansion devices 48 may be integrated.

Figure 3:
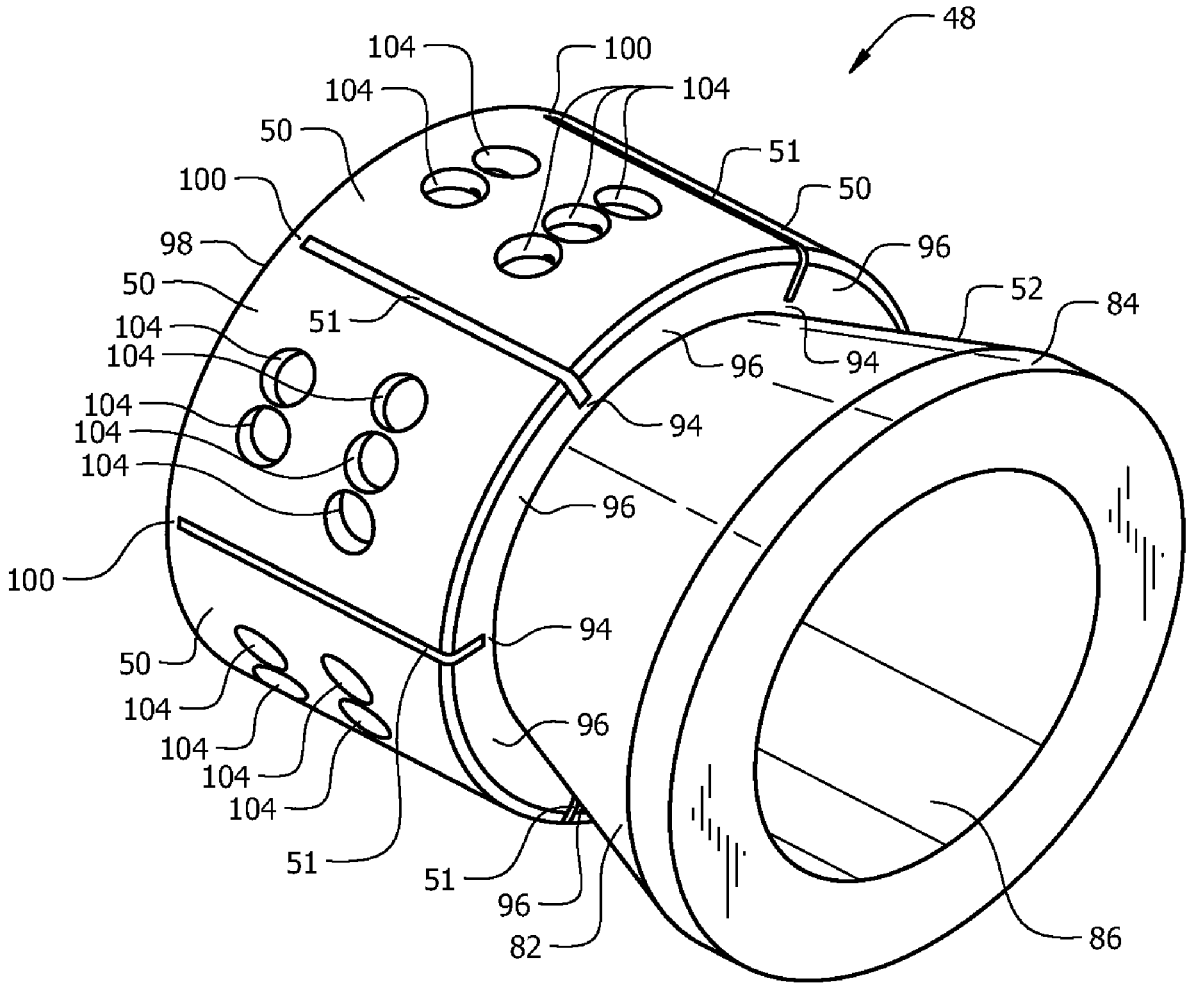
FIG. 3 is an oblique view of an expansion device of the bridge plug tool of FIG. 1 with the expansion device in its run in configuration.
Figure 4:
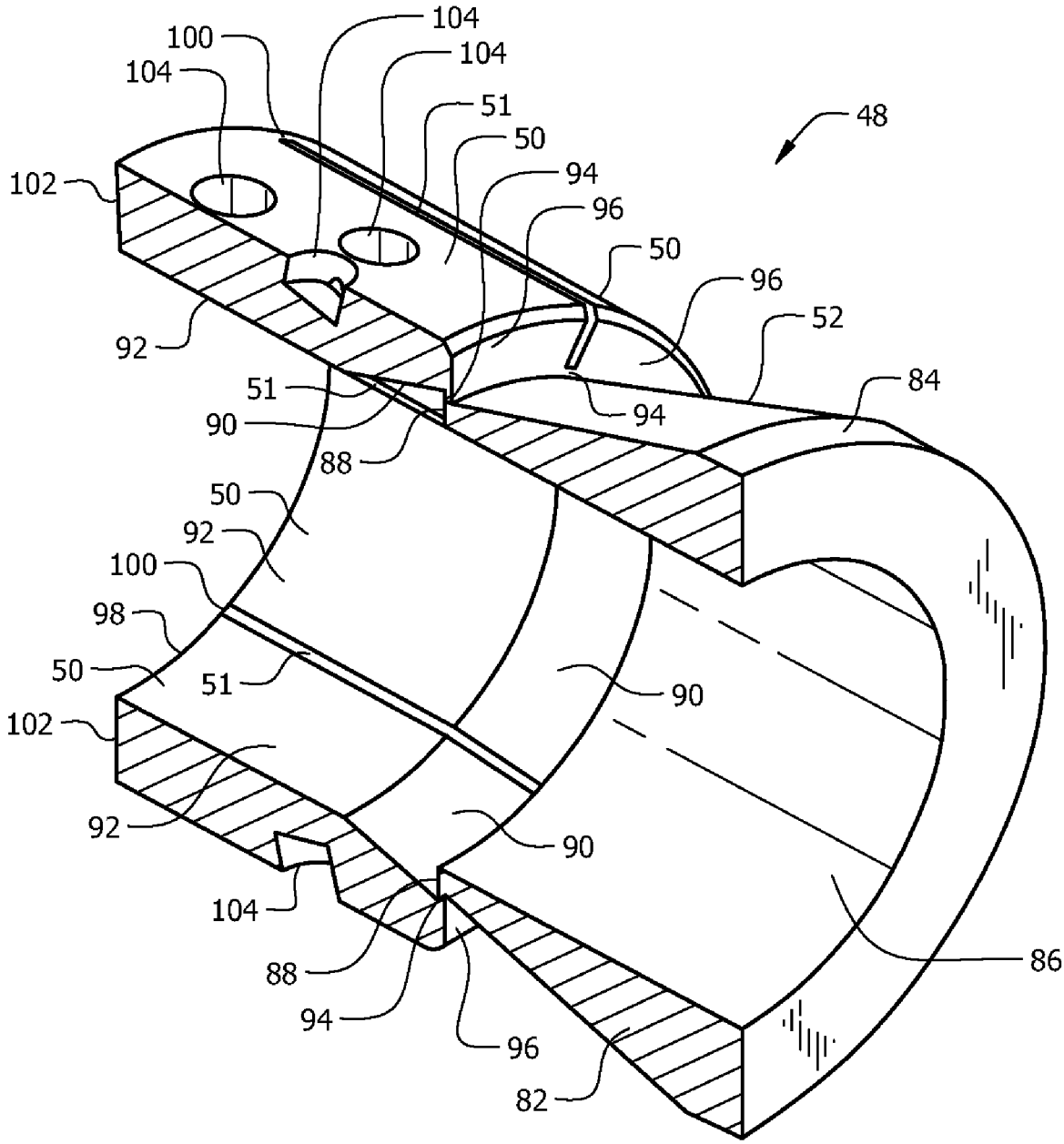
FIG. 4 is an oblique cross-sectional view of the expansion device of FIG. 3.
Figure 5:
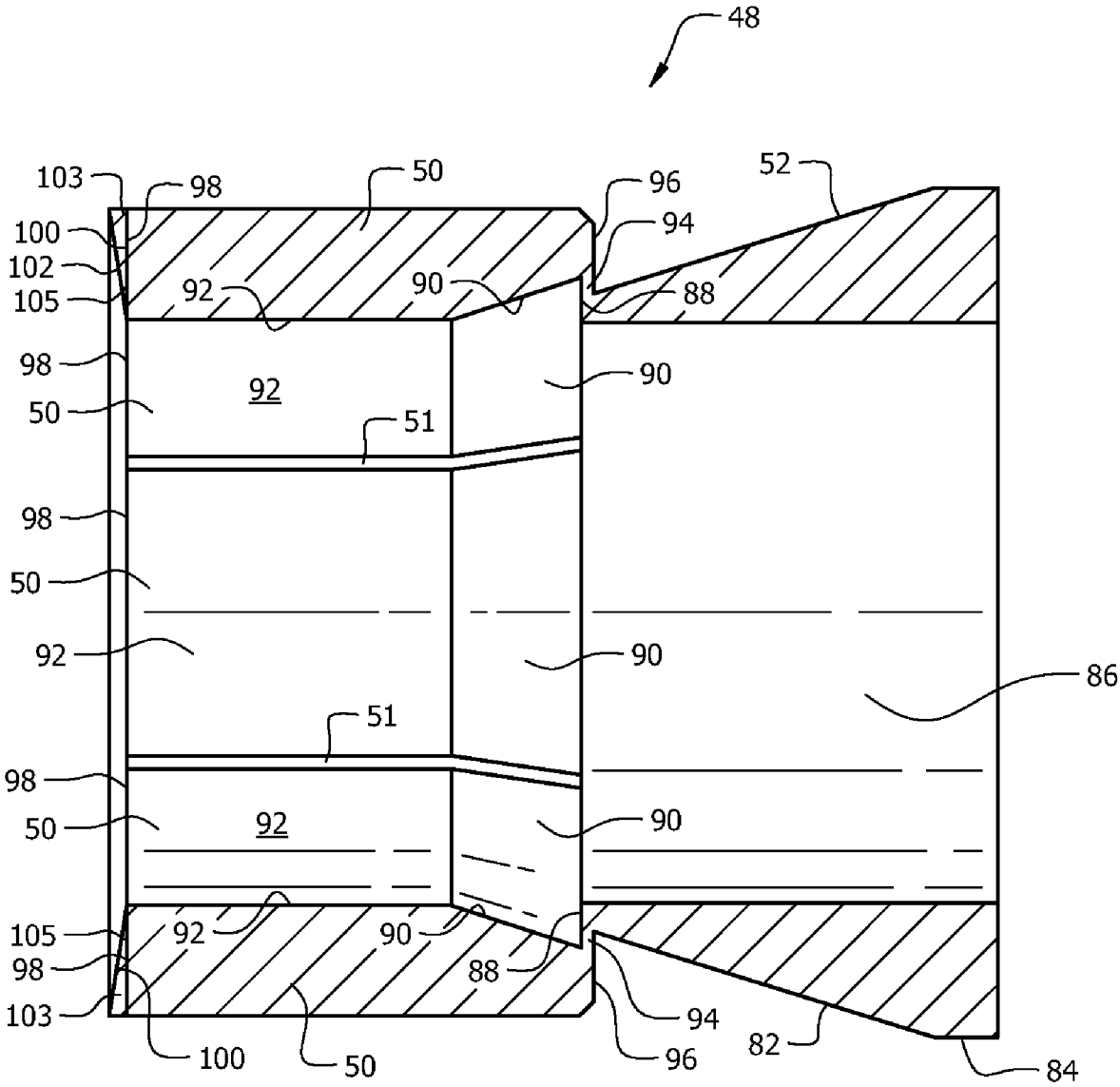
FIG. 5 is an orthogonal cross-sectional view of the expansion device of FIG. 3.

Referring now to FIGS. 3-5, an expansion device 48 is shown in greater detail. Most generally, the expansion device 48 is configured so that the wedge 52 comprises a generally frusto-conical wall 82 and an annular wedge base 84 that forms a base of the frusto-conical shape. It will be appreciated that while the wall 82 and the base 84 are described as separate geometric structures, in this embodiment, the wall 82 and the base 84 are formed integrally. The wedge 52 further comprises an inner surface 86 that defines a space that is substantially cylindrical in shape and is configured to accept the packer mandrel 28 coaxially therein. A tip end 88 of the wedge 52 forms a truncated tip end of the frusto-conical shape of the wall 82.

Collectively, the slip segments 50 are generally configured as angular segments of a substantially cylindrical tube. In this embodiment, an angular array of eight slip segments 50 are disposed equidistant from the central axis 40 and parallel to the central axis 40. But for small portions of material that are described in greater detail below, adjacent slip segments 50 are angularly separated from each other about the central axis by relatively thin gaps 51 that run generally parallel to the central axis 40. Each slip segment comprises an incline surface 90 formed as a recessed portion of an inner surface 92 of the slip segment 50. The incline surface 90 is formed as a generally frusto-conical incline segment having an incline angle complementary to an incline angle of the frusto-conical wall 82 of the wedge 52. In order to allow the expansion device 48 to maintain the shape as described, the plural slip segments 50 and the wedge 52 are integrally joined together as described below.

It will be appreciated that each slip segment 50 is joined to the wedge 52 by a bridge 94 of material disposed generally radially between the frusto-conical wall 82 of the wedge 52 and the inclined surface 90 of the slip segment 50. In this disclosure, the term "bridge" is meant to refer to any portion of material integrally formed with both a slip segment 50 and the wedge 52 and which serves to join the slip segment 50 to the wedge 52. In this embodiment, the bridge 94 extends substantially along the entire length of the incline surface 90 near where the incline surface 90 adjoins an incline end 96 of the slip segment 50. Of course, in alternative embodiments, the bridge 94 may only partially extend along the above-described circumferential interface and/or multiple bridges 94 may join a singe slip segment 50 to the wedge 52.

Further, it will be appreciated that the multiple slip segments 50 are joined at their distal ends 98 to adjacent slip segments 50 in the radial array of slip segments 50 by a slip link 100. The slip link 100 is formed generally as a thin annular ring of material that extends between adjacent slip segments 50 and generally continuously covers the distal ends 98. Of course, in alternative embodiments, slip links 100 may only partially extend along the distal ends 98 and/or multiple slip links 100 may join a singe slip segment 50 to the adjacent slip segments 50. Further, while the slip link 100 in this embodiment comprises a sloped end 102, alternative embodiments may not comprise such a sloped end 102. The sloped end 102 is configured so that a thicker portion 103 of the slip link 100 joins the radially outermost portions of the slip segments 50 as compared to a thinner portion 105 of the slip link 100 that joins the radially innermost portions of the slip segments 50.

It will be appreciated that in this embodiment, but for the bridges 94 and the slip link 100, angularly adjacent slip segments 50 are otherwise separated from each other by gaps 51. Accordingly, it can be seen in FIGS. 3 and 4 that, in this embodiment, gaps 51 extend continuously from the slip link 100 to the respective bridge 94. Of course, in alternative embodiments, small amounts of material may join adjacent walls of slip segments 50 so that the gaps 51 are not continuous in the above-described manner.

In this embodiment, each slip segment 50 further comprises a plurality of receptacles 104 configured to receive complementary shaped tooth buttons that extend from the receptacles 104 to engage the casing 22 when the slip segments 50 are in a set configuration. Alternatively, the receptacles 104 may receive mounting posts of tooth plate assemblies 106, as shown in FIG. 6, for similarly engaging the casing 22 when the slip segments 50 are in a set configuration. It will be appreciated that whatever elements are received into receptacles 104, in some embodiments, the radially outermost portions of those elements may be limited from extending radially beyond a critical distance, beyond such critical radial distance, the elements may inadvertently engage the casing 22. In other words, to prevent undesirable transition of the tool 10 from the run in configuration, in some embodiments, it may be advantageous to radially limit the distance elements that are carried by the slip segments 50 may protrude. In alternative embodiments, teeth or other protruding elements may be formed integrally with the slip segments 50.

With reference to FIGS. 1-6, operation of the tool 10 will be described. The tool 10 in the FIG. 1 run in configuration is typically lowered into, i.e. run in, a well by means of a work string of tubing sections or coiled tubing attached to the upper end 16 of the tool 10. A setting tool may be part of the work string. When the tool 10 is at a desired depth in the well, the setting tool is actuated and it drives the spacer ring 44 from its run in configurations of FIGS. 1 and 2 to the set configuration shown in FIG. 6. As this is done, the shear pins 46 and 54 are sheared.

As the distance between the spacer ring 44 and the mule shoe 78 is decreased, each of the expansion devices 48 are longitudinally compressed. With sufficient compression and sufficient resultant relative movement between a wedge 52 and its connected slip segments 50, the bridge 94 and/or bridges 94 are sheared, thereby separating the wedges 52 from their associated slip segments 50. With subsequent further relative movement between a wedge 52 and its connected slip segments 50, such movement generally occurring with a sliding of the incline surfaces 90 along the frusto-conical wall 82, the wedge 52 forces the individual slip segments 50 radially outward. With sufficient radially outward movement of slip segments 50, the portions of slip links 100 joining the slip segments 50 are sheared. Accordingly, in the manner described above, the previously joined and unitary wedge 52 and slip segments 50 become separate and move into their so-called set configurations. Of course, with still further sufficient reduction in distance between the spacer ring 44 and the mule shoe 78, the packer elements 57, 58 seal against the casing 22 and the tooth plate assemblies 106 and/or other gripping elements carried by the slip segments 50 also engage the casing 22. FIG. 6 shows the expansion device 48 in such a set configuration with the slip segments 50 separated from each other and from the associated wedges 52. FIG. 6 further shows the packer element 57 and tooth plate assemblies 106 engaged with casing 22.

Figure 7:
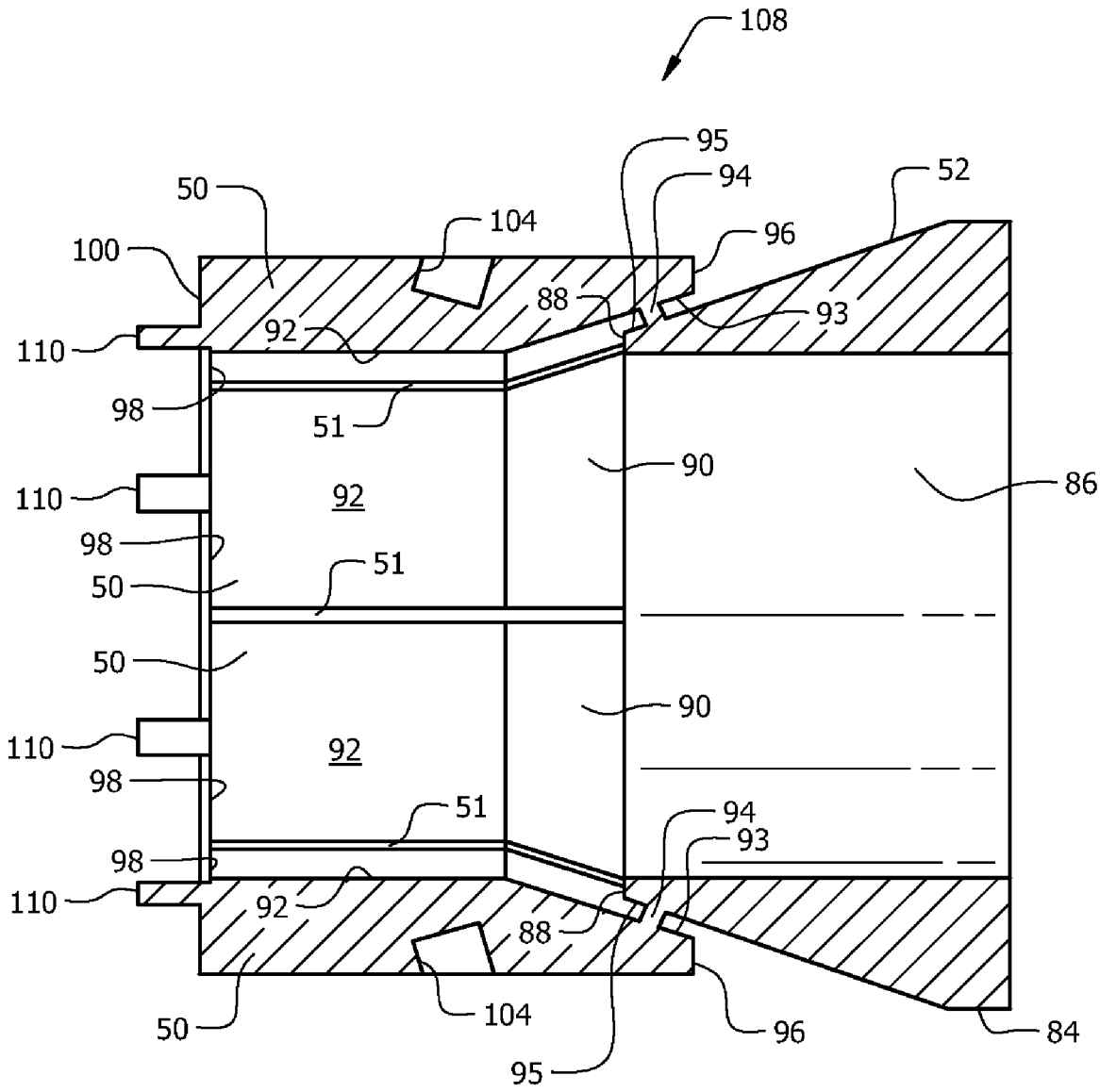
FIG. 7 is an orthogonal cross-sectional view of an alternative expansion device.

Referring now to FIG. 7, an orthogonal cross-sectional view of an alternative embodiment of an expansion device is shown as expansion device 108. Expansion device 108 is substantially similar in form and function to expansion device 48. However, expansion device 108 differs from expansion device 48 in part because the bridge 94 is located along the incline surface 90 an offset distance 93 from the incline end 96 of the slip segment 50. Similarly, the bridge 94 is located along the frusto-conical wall 82 an offset distance 95 from the tip end 88 of the wedge 52. Such placement of the bridge 94 provides an increased radial overlap between the slip segments 50 and the wedge 52.

Still referring to FIG. 7, the expansion device 108 further differs from the expansion device 48 because expansion device 108 comprises tabs 110 extending longitudinally from the slip link 100 and/or the distal ends 98 of the slip segments 50. Such tabs 110 may be received within complementary channels and/or receptacles formed in adjacent components of the tool 10. For example, the mule shoe 78 and/or the spacer ring 44 may be configured to receive the tabs 110 while the expansion device 108 is in the run in configuration. With the tabs 110 sufficiently received by the mule shoe 78, the slip segments 50 can be retained inward toward the longitudinal central axis 40 thereby preventing undesirable interference between the slip segments 50 and the elements of the well 15. Operation of the expansion device 108 is substantially similar to the operation of the expansion device 48 with the exception that, upon the above-described sufficient radially outward movement of slip segments 50, the tabs 110 are sheared along with the shearing of the slip links 100 that join the slip segments 50. It will be appreciated that the expansion devices 48, 108 may be constructed of a composite material such as fiberglass, metal (e.g., aluminum, steel, cast iron, or magnesium), or any other suitable material. It will further be appreciated that the expansion devices may be constructed by molding, forging, casting, pressing, machining and/or any other suitable construction technique.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What we claim as our invention is:

1. An expansion device for a wellbore servicing tool, comprising:

a wedge comprising a frusto-conical wall having a tip end, the wedge being configured coaxially along a central axis;

a plurality of slip segments, each slip segment comprising an inner surface having an incline surface; and a single bridge joining each of the incline surfaces to the frusto conical wall, wherein the bridge is formed as one piece with each of the incline surfaces and the frusto conical wall, and wherein the bridge extends radially between each of the incline surfaces and the frusto conical wall.

2. The expansion device of claim 1, wherein the bridge extends continuously about the central axis.

3. The expansion device of claim 1, wherein an incline angle of the frusto-conical wall is substantially equal to an incline angle of at least one of the incline surfaces.

4. The expansion device of claim 1, wherein at least one of the slip segments comprises a distal end opposite an incline end associated with the incline surface and wherein the at least one of the slip segments comprises a tab extending longitudinally outward from the incline end and substantially parallel to the central axis.

5. The expansion device of claim 1, wherein at least one of the slip segments comprises a distal end opposite an incline end associated with the incline surface and wherein the bridge is located along the incline surface an offset distance from the incline end.

6. The expansion device of claim 1, wherein the bridge is located along the frusto-conical wall an offset distance from the tip end.

7. The expansion device of claim 1, wherein at least one of the slip segments comprises a distal end opposite an incline end associated with the incline surface, wherein the bridge is located along the incline surface an offset distance from the incline end, and wherein the bridge is located along the frusto-conical wall an offset distance from the tip end.

8. The expansion device of claim 1, wherein at least one of the slip segments comprises a receptacle for receiving a portion of a tooth plate assembly.

9. The expansion device of claim 1, wherein at least one of the slip segments comprises a receptacle for receiving a button tooth.

10. The expansion device of claim 1, wherein at least two adjacent slip segments each comprise a distal end opposite an incline end associated with the incline surfaces and wherein the distal ends of the at least two adjacent slip segments are joined by a slip link.

11. The expansion device of claim 10, wherein the slip link extends continuously about the central axis.

12. The expansion device of claim 10, wherein the slip link joins all of the plurality of slip segments.

13. The expansion device of claim 10, wherein an additional amount of material joins the at least two adjacent slip segments, and wherein the additional amount of material is disposed at a position between the distal end and the incline end of the at least two adjacent slip segments.

14. A method of operating a wellbore servicing tool, comprising:

longitudinally compressing an expansion device along a central axis;

upon sufficient compression, separating plural slip segments from a wedge by shearing a single bridge joining each of the slip segments to the wedge, wherein the bridge is formed as one piece with each of the slip segments and the wedge;

moving the wedge relative to the slip segments; and upon sufficient movement of the wedge relative to the slip segments, separating at least two slip segments from each other by shearing an integrally formed link joining the at least two slip segments.

15. The method of claim 14, wherein moving the wedge relative to the slip segments increases a radial distance between the slip segments and the central axis.

16. The method of claim 15, wherein upon achieving a sufficient increase in radial distance between the slip segments and the central axis at least one of a portion of a slip segment or a device carried by a slip segment contacts at least one of a casing and a wellbore.

17. The method of claim 15, wherein a packer element sealingly engages at least one of a casing and a wellbore prior to at least one of a portion of a slip segment and a device carried by a slip segment contacting at least one of the casing and the wellbore.

18. The method of claim 14, wherein the wellbore servicing tool is a bridge plug.

19. The method of claim 14, wherein the wellbore servicing tool is a fracture plug.

20. The method of claim 14, wherein the wellbore servicing tool is a zonal isolation tool.

* * * * *